US010486193B2

(12) United States Patent
Preckel et al.

(10) Patent No.: US 10,486,193 B2
(45) Date of Patent: Nov. 26, 2019

(54) METHOD AND DEVICE FOR TREATING CONTAINERS

(75) Inventors: Katrin Preckel, Gelsenkirchen (DE); Martin Schach, Bochum (DE); Gernot Keil, Braunweiler (DE); Markus Reiniger, Monchengladbach (DE)

(73) Assignee: KHS GmbH, Dortmund (DE)

( * ) Notice: Subject to any disclaimer, the term of this patent is extended or adjusted under 35 U.S.C. 154(b) by 1718 days.

(21) Appl. No.: 13/819,446

(22) PCT Filed: May 19, 2011

(86) PCT No.: PCT/EP2011/002502
§ 371 (c)(1),
(2), (4) Date: Feb. 27, 2013

(87) PCT Pub. No.: WO2012/028215
PCT Pub. Date: Mar. 8, 2012

(65) Prior Publication Data

US 2013/0160405 A1 Jun. 27, 2013

(30) Foreign Application Priority Data

Sep. 2, 2010 (DE) ..... 10 2010 044 244

(51) Int. Cl.
*B05D 3/06* (2006.01)
*B41J 3/407* (2006.01)
(Continued)

(52) U.S. Cl.
CPC ..... *B05D 3/06* (2013.01); *B05D 3/067* (2013.01); *B41J 3/4073* (2013.01); *B41J 11/002* (2013.01); *B65B 55/08* (2013.01); *B67C 7/0086* (2013.01); *B67C 2003/227* (2013.01); *B67C 2003/228* (2013.01)

(58) Field of Classification Search
None
See application file for complete search history.

(56) References Cited

U.S. PATENT DOCUMENTS 3,556,174 A * 1/1971 Gibble ..... B65B 31/00 141/69
3,955,286 A * 5/1976 Anrep ..... A61L 2/12 34/263

(Continued)

FOREIGN PATENT DOCUMENTS

CH 595 248 A5 2/1978
DE 10 2006 001 223 A1 7/2007

(Continued)

*Primary Examiner* — Hemant Desai
*Assistant Examiner* — Tanzim Imam
(74) *Attorney, Agent, or Firm* — Occhiuti & Rohlicek LLP

(57) ABSTRACT

A method for treating containers in which, at a treatment station, the containers are provided on container outer surfaces thereof with a print that including a colorant. The colorant can be dye or ink. The method includes, at a treatment station, processing the colorant by irradiating the containers with non-thermal energy radiation. Processing the colorant includes drying or curing it. The method also includes decontaminating a region of the containers with the same radiation, either by disinfecting or sterilizing it. The region includes either or both a container opening and a container inner surface.

30 Claims, 7 Drawing Sheets

(51) Int. Cl.

| | |
|---|---|
| ***B41J 11/00*** | (2006.01) |
| ***B65B 55/08*** | (2006.01) |
| *B67C 7/00* | (2006.01) |
| *B67C 3/22* | (2006.01) |

(56) References Cited

U.S. PATENT DOCUMENTS 5,020,303 A * 6/1991 Vokins ..... B65B 55/025 426/399
5,195,294 A * 3/1993 Baranowski ..... 53/167
5,715,874 A * 2/1998 Reynolds et al. ..... 141/2
6,209,988 B1 * 4/2001 Sueoka ..... B41J 2/16 347/50
6,264,317 B1 * 7/2001 Raulinaitis ..... B41J 2/17503 347/45
6,328,078 B1 * 12/2001 Wildeman ..... D03J 1/007 101/481
6,457,823 B1 * 10/2002 Cleary ..... B41J 11/002 347/102
2002/0104456 A1 * 8/2002 Detzner ..... C03C 17/245 101/483
2002/0129833 A1 * 9/2002 Drzal ..... B05D 3/062 134/1
2004/0011969 A1 * 1/2004 Cekic ..... B05D 3/067 250/504 R
2004/0047762 A1 * 3/2004 Masaoka ..... B65B 55/04 422/22
2004/0071891 A1 * 4/2004 Luka ..... 427/421
2004/0085423 A1 * 5/2004 Bronstein ..... B41J 11/002 347/102
2005/0171227 A1 * 8/2005 Weine Ramsey ..... 522/1
2005/0248946 A1 * 11/2005 Geller ..... B05D 3/067 362/297
2006/0000518 A1 * 1/2006 Allen ..... B67C 3/222 141/67
2006/0011263 A1 * 1/2006 Till ..... B65B 55/08 141/147
2006/0257681 A1 * 11/2006 Wolf ..... B05D 3/06 428/626
2007/0110611 A1 * 5/2007 Teran ..... A61L 2/202 422/28
2007/0115335 A1 * 5/2007 Vosahlo ..... B41J 11/002 347/102
2007/0157559 A1 * 7/2007 Till ..... B41J 2/06 53/411
2007/0281099 A1 * 12/2007 Howarth ..... H05K 3/125 427/402
2008/0073549 A1 * 3/2008 Avnery ..... B65B 55/08 250/397
2008/0079796 A1 * 4/2008 Makuta ..... B41J 11/0015 347/102
2008/0138243 A1 * 6/2008 Kristiansson ..... A61L 2/087 422/23
2008/0239045 A1 * 10/2008 Umebayashi ..... C09D 11/101 347/102
2008/0286537 A1 * 11/2008 Lefaux ..... B41M 7/0027 428/203
2009/0013648 A1 * 1/2009 Mastio ..... A61L 2/082 53/426
2010/0054987 A1 * 3/2010 Krueger ..... A61L 2/082 422/3
2010/0148065 A1 6/2010 Kivlehan
2010/0192517 A1 * 8/2010 Schach ..... B41J 2/0057 53/411
2010/0209290 A1 8/2010 Cirri et al.
2010/0257819 A1 * 10/2010 Schach ..... B41J 3/4073 53/411
2011/0012032 A1 * 1/2011 Bufano ..... A61L 2/087 250/492.3
2011/0162226 A1 * 7/2011 Witt ..... B05D 3/066 34/276

FOREIGN PATENT DOCUMENTS

DE 10 2008 054 110 A1 5/2010
WO 2004/064874 A2 8/2004
WO WO 2009018892 A1 * 2/2009 ..... B41J 2/0057
WO WO 2009052890 A1 * 4/2009
WO WO-2009052890 A1 * 4/2009 ..... B41J 3/4073
WO WO 2010028747 A2 * 3/2010 ..... B05D 3/066
WO 2010/034375 A1 4/2010

* cited by examiner

METHOD AND DEVICE FOR TREATING CONTAINERS

CROSS REFERENCE TO RELATED APPLICATION

This application is the national phase under 35 USC 371 of international application no. PCT/EP2011/002502, filed May 19, 2011, which claims the benefit of the priority date of German application no. 10 2010 044 244.5, filed Sep. 2, 2010. The contents of the aforementioned applications are incorporated herein in their entirety.

FIELD OF INVENTION

The invention relates to container processing, and in particular, to printing and sterilizing containers.

BACKGROUND

It is known to directly print on a bottle immediately after a stretch-molding or blow-molding machine has manufactured the bottle from a preheated preform. It is also known to dry or cure the printed image by irradiating the printed containers with UV radiation, electron radiation, microwave radiation, or heat radiation in the form of infrared radiation.

Known ways of disinfecting or sterilizing of containers before they are filled with filling material include exposure to plasma discharge, as well as exposure to radiation, including UV radiation, electron radiation, microwave radiation, thermal radiation, or infrared radiation.

A disadvantage of the known technology is that separate, complex and costly methods and devices are necessary for the drying or curing of the printed images and for the disinfecting or sterilizing of the containers.

SUMMARY

An object of the invention is that of drying or curing printing dye or a printed image as well as the disinfecting or sterilizing of the containers.

According to the invention, the same type of energy radiation is used for both drying a printed image and sterilizing the container. In some embodiments, this radiation is a non-thermal radiation. Among these types of non-thermal radiation is UV radiation.

In some embodiments, sterilizing a container region includes directly irradiating it with the energy radiation.

In some embodiments, containers are already sterile when provided to an installation. In these embodiments, the only likely contamination will be in the mouth region of the container during handling within the installation. In such embodiments, it is only necessary to sterilize the mouth or opening region of the containers by irradiating them with the energy radiation.

Other embodiments carry out a complete sterilization of the container, including not only the mouth region but also the entire inner surface of the container.

In some embodiments, radiation enters the container without going through a wall thereof. This is useful for plastic containers, such as PET, when radiation used for sterilization would be absorbed in large part by the wall. This achieves optimum sterilization with only a small amount of radiation energy.

A particularly useful form of radiation is UV radiation. UV radiation acts on photo-initiators present in the printing dye to form radicals that promote cross linking of the monomers and/or oligomers of the printing dye, thereby promoting curing of the dye. UV radiation also damages DNA or RNA molecules of any bacteria present on the bottle's surface, thereby preventing cell division and achieving the desired sterilization.

In a preferred embodiment, drying or curing of the printing dye and sterilizing containers are carried out in the same treatment station. In others, they are carried out in one and the same treatment or work module or in one and the same work machine or workstation having a plurality of treatment stations.

Drying or curing printing dye and sterilizing containers with one and the same type of energy radiation, preferably UV radiation, has many advantages.

One advantage is that no chemicals are used. This means that there are no chemical residues left behind in sterilized containers.

Another advantage is that no volatile organic constituents are formed during the drying or curing of the printing dye. In addition, basically no thermal energy is needed. This avoids possible thermal damage to containers. On the other hand, this does not preclude the possibility of using small amounts of heat to accelerate drying or curing. However, the amount of heat used can be controlled to avoid thermal damage.

Another advantage is that both the drying and curing process and the sterilization process can be carried out very quickly with UV radiation. This makes it possible to optimally sterilize the treated surfaces of the containers in fractions of a second, and at most, in a few seconds and to cure or dry the printing dye in fractions of a second, and at most, in a few seconds.

Another advantage, at least for those embodiments in which dye curing and container sterilization take place in a common treatment station is that it becomes possible to avoid separate mechanisms for cooling the UV sources. Only one such cooling system needs to be provided.

In those embodiments that use radiation, another advantage is that the radiation is only present in one part of the overall installation. It is only here that screening is required to avoid exposing personnel to radiation.

Yet another advantage of using the same type of radiation for both curing and sterilizing, then the radiation sources can be acquired in greater quantities, thus potentially reducing costs per radiation source.

Yet another advantage is that when non-thermal radiation is used, and in particular, UV radiation, there is no increase in temperature that might damage the containers. To ensure that this is the case, it is possible to use a filter at the radiation source to filter out any quanta of infrared radiation.

A variety of UV lamps can be used. These include low-pressure and medium pressure mercury radiators, excimer radiators, exciplex radiators, amalgam lamps, LEDs, and xenon lamps. During treatment, a transport system moves the containers through a treatment section and/or rotates or swivels them about their container axis.

The container surface that is to be printed upon preferably undergoes pretreatment to improve the adhesion strength of the print. This pretreatment includes exposure to UV radiation in the 170-200 nm range. Such UV radiation splits oxygen molecules in the ambient air to form ozone. The UV radiation then breaks down the ozone. This forms highly reactive O* radicals. The O* radicals promote splitting or oxidation of organic molecules on the container surface. The UV radiation also forms other radicals such as COO*, *OH, CO* and COOH*. These disturb the symmetry of the plastics, thereby increasing the surface energy of the plastic containers. This improves adhesion between the printing dye and the container surface.

A preferred embodiment includes drying or curing the printing dye and/or sterilizing containers in an atmosphere that includes a process gas, a shielding gas, an inert gas, or mixtures thereof. Suitable inert gases include nitrogen, carbon dioxide, or a noble gas, such as argon, helium, krypton, and xenon.

In some embodiments, the process gas purges the container interior. Among these are embodiments in which it cools the containers during the treatment. For such embodiments, the process gas is cooler than the container. As a result, during treatment, the process gas absorbs any heat given off by the container. As it does so, the process gas becomes less dense and therefore rises until it flows out of the container mouth. This tends to suppress the ingress or diffusion of any oxygen into the container. Such oxygen is undesirable because any residual oxygen in a container can harm the filling material when the container is filled.

The manner in which warmed inert gas flowing out of the container suppresses flow of oxygen into the container has been demonstrated for both upside-down and right-side up containers in which a gas that is some 10 K colder than the container suppresses the diffusion of oxygen into the container for more than 10 seconds. Colder gas fillings have an even better effect.

In general, short-wave quanta are more effective at disinfecting than long wave quanta. It so happens, however, that short-wave UV quanta are more prone to using up their energy dissociating oxygen molecules than are long-wave quanta Another advantage of filling the container with a suitable shielding or inert gas is that more of the UV quanta emitted from the UV source will be available for sterilizing. This is because if oxygen is present, many UV quanta will spend their energy dissociating oxygen molecules instead of harming bacteria. By filling a container with inert gas, one purges these energy-robbing oxygen molecules. This means that one can use the more effective short-wave UV quanta for sterilization.

As used herein, "short-wave UV quanta" refers to quanta carrying energy associated with a free-space wavelength of less than 240 nm. "Long-wave UV quanta" are quanta that carry energy associated with free-space wavelengths of more than 240 nm. In general, the effectiveness of UV quanta increases as their associated free-space wavelengths decrease because such quanta carry more energy.

The drying or curing of a printing dye and/or container sterilization occurs preferably in a low-oxygen inert gas atmosphere formed for example by the aforementioned process gas inside an enclosure formed of metal sheets, cages, or hoods that can contain the low-oxygen atmosphere and isolate it from the surrounding environment.

Preferred ranges of free-space wavelength include between 170 nm and 280 nm, between 170 nm and 220 nm, and between 170 nm and 200 nm. These ranges are suitable for both drying or curing printing dye and/or for sterilizing containers.

The oxygen's partial pressure in the shielding gas atmosphere is no more than 0.5% of the total pressure no more than 0.1% of the shielding gas atmosphere. This low partial pressure of oxygen reduces energy loss from absorption of UV radiation by molecular oxygen and consequent ozone formation.

During the pretreatment of the container outer surface to improve the adhesion strength of the at least one printing dye or of the printed image by increasing the surface energy, a disinfection or sterilization of the outer wall of the container is preferably effected at the same time.

During the treatment, container carriers or container grippers hold and/or move the containers. The container carriers or container grippers are preferably also disinfected by the energy radiation together with the containers. Alternatively, additional sterilization units sterilize container carriers or container grippers after they have been uncoupled from the containers.

In an alternative embodiment, each container carrier or container gripper remains coupled to a particular container over the whole treatment section. At the end of the treatment section, each container carrier or container gripper is uncoupled from its associated container. The container carrier or container gripper is then returned, already sterilized, to the start of the treatment section or to the start of an installation that includes the treatment section.

As used herein, "containers" refers to cans, bottles, tubes, and pouches, whether made of metal, glass and/or plastic, as well as other packaging containers suitable for filling with liquid or viscous products for either pressurized filling or for a filling at ambient pressure.

The expression "treating containers" refers to printing, including digital printing, on an outer surface of a container using printing dye, and preferably polychrome printing using printing dyes of different hues, drying or curing of the dye, preferably by cross linking, as well as the sterilizing or disinfecting of the containers at a container region at which sterilization is necessary, while at the same time taking into account the complete process sequence for example within a container filling installation and/or taking into account the condition of the containers to be treated and/or taking into account the production method of these containers, for example from plastic, e.g. PET, by blow molding.

As used herein, "printing" refers to applying of one of more printed images, in particular also multi-color printed images, to the a container's outer surface and doing so using an inkjet print head or any other printing method using a printing dye that is dried or cured by energy input, for example by heat, UV radiation, microwave radiation and/or electron radiation, preferably by cross linking.

As used herein, "non-thermal or substantially non-thermal energy radiation" refers to energy radiation that contains at most an insignificant amount of thermal or infrared radiation. Such non-thermal or substantially non-thermal energy radiation includes, in particular, UV radiation, beta or electron radiation, and microwave radiation.

As used herein, "substantially" refers to variations from an exact value of no more than ±10%, preferably of no more than ±5% and/or variations in form of changes that are insignificant for function.

Further embodiments, advantages, and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE FIGURES

The invention is explained in detail below through the use of embodiment examples with reference to the figures. In the figures.

DETAILED DESCRIPTION

Figure 1:
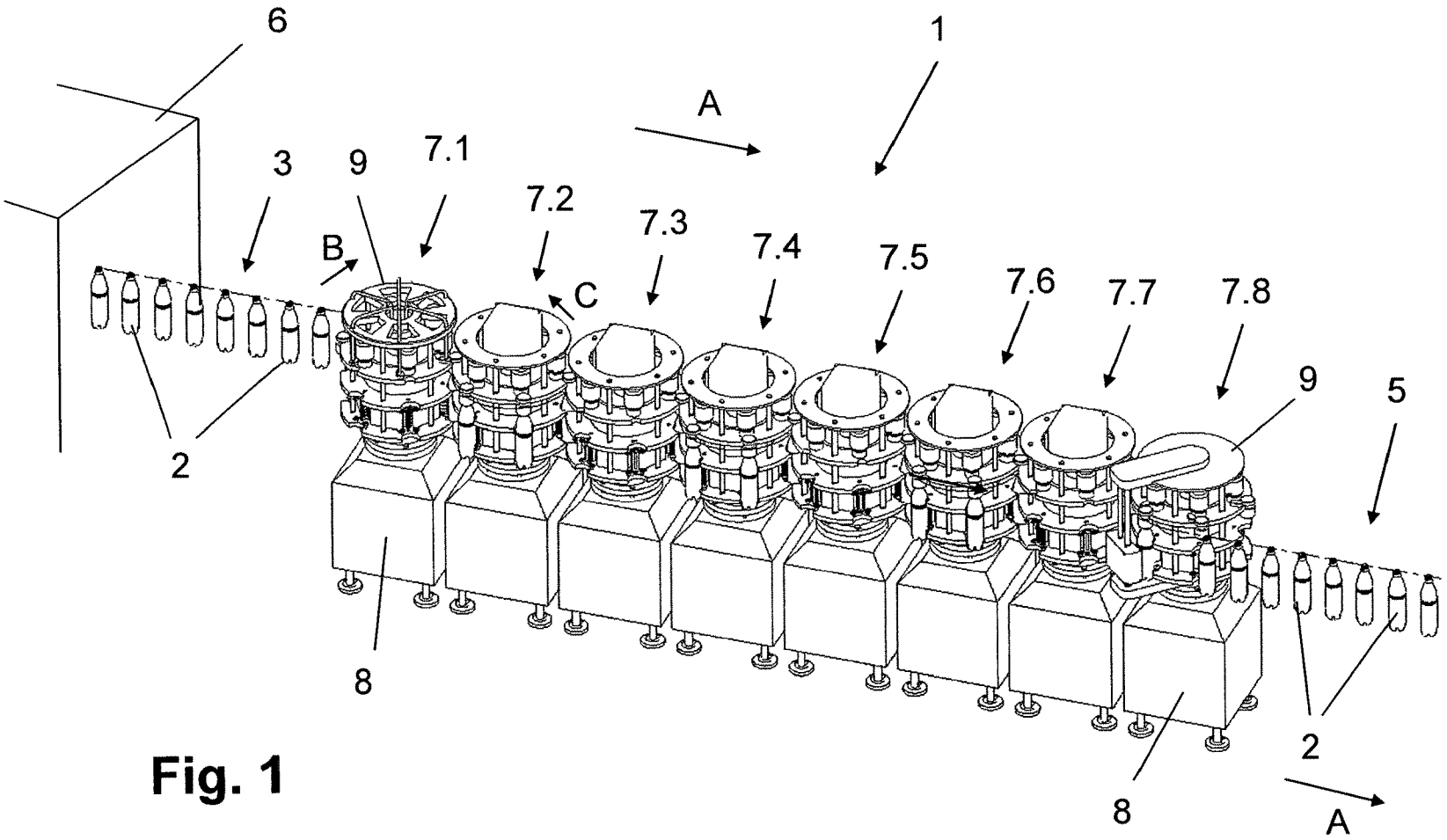
FIG. 1 shows a simplified perspective depiction of an installation for the treatment of containers in the form of bottles (PET bottles in this case) in simplified perspective depiction.
Figure 4:
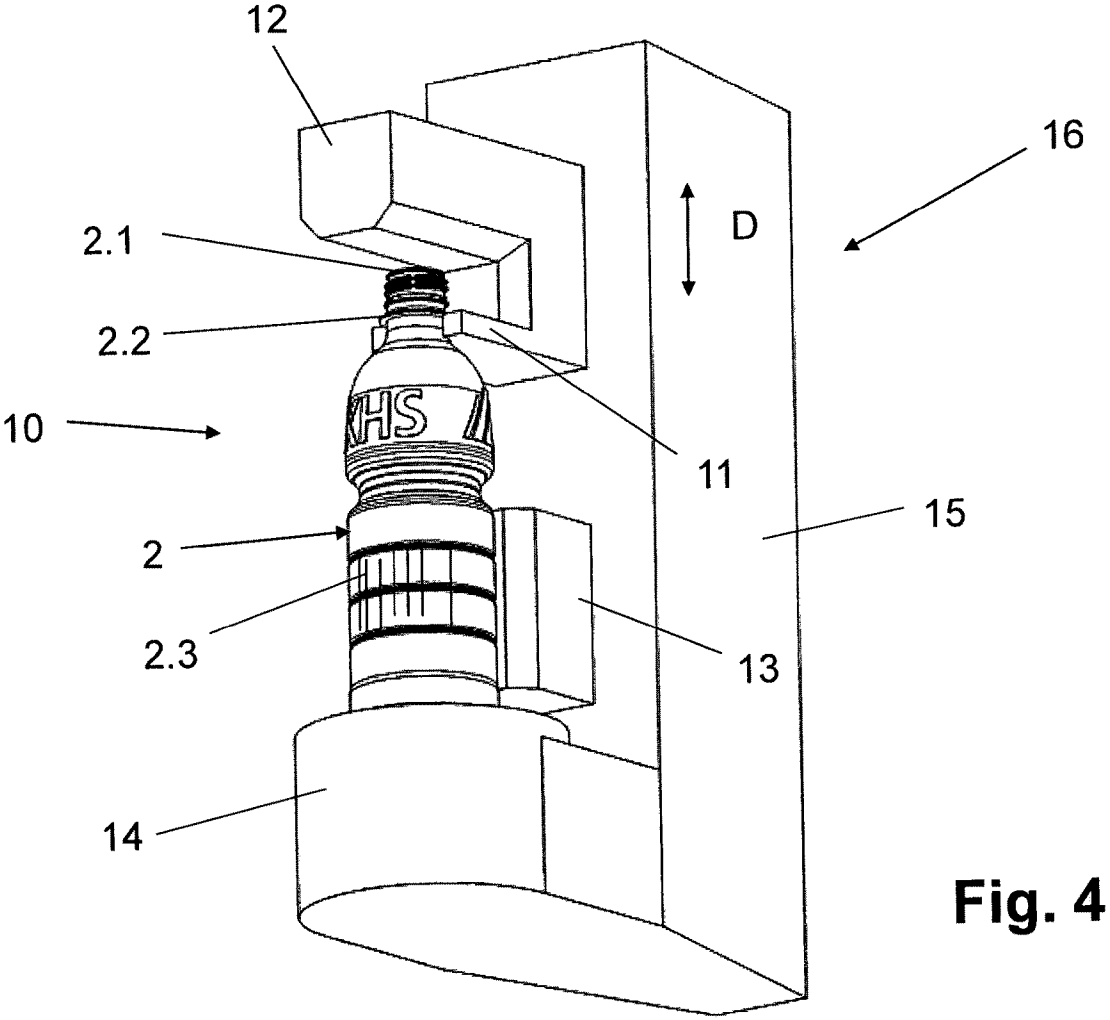
FIG. 4 shows a schematic, perspective depiction of one of the treatment positions of the treatment module of FIG. 3.

FIG. 1 shows a treatment section 1 that is used for treating containers in the form of bottles 2. A first conveyor 3 provides the treatment section 1 with hanging bottles 2. These bottles 2 hang from, or are suspended by, a flange or neck ring 2.2 formed below the bottle's opening 2.1, as can be seen in FIG. 4.

Figure 2:
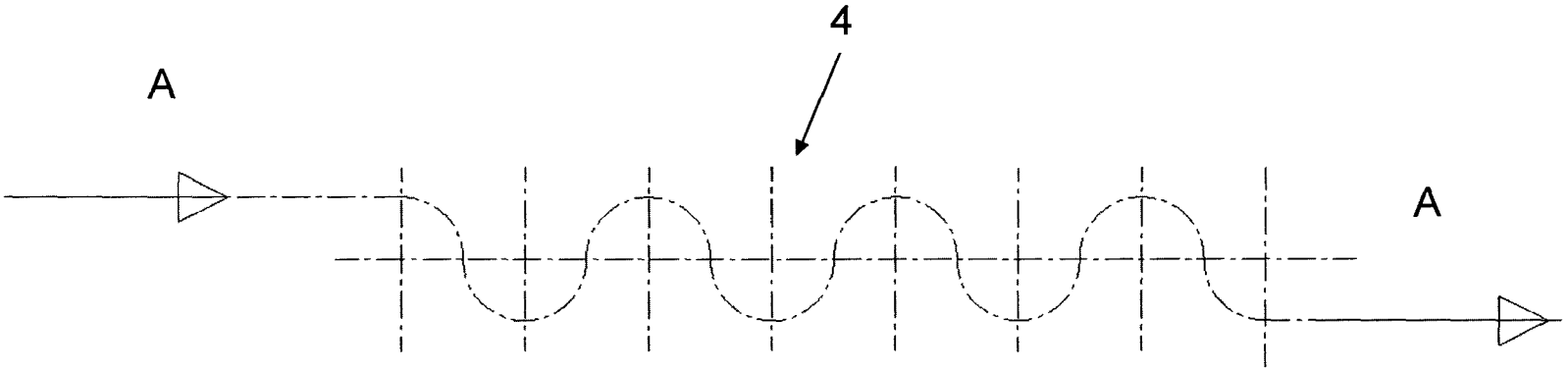
FIG. 2 shows a schematic depiction of the transport path of the respective container through the installation of FIG. 1.

As shown in FIG. 2, the bottles 2 move along a transport direction A through the treatment section 1 along a meandering transport path 4. Treated bottles 2 leave the treatment section 1 at a container outlet again suspended from a second conveyor 5. The second conveyor 5 conveys bottles 2 to a further use, for example to a filling machine.

The bottles 2 are produced from preforms by stretch or blow molding in a blow-molding machine 6. The method is of course not confined to PET bottles but can also be used for other plastic bottles, such as those made from PE, PP, PLA or PHB.

In the illustrated embodiment, the treatment section 1 is a modular treatment section having first through eighth treatment modules 7.1-7.8 that follow one another along the transport direction A according to the sequence defined by their reference numbers. As a result, $n^{th}$ treatment module **7.*n* passes bottles 2 to $(n+1)^{th}$ treatment module 7. (n+1) along the transport path 4**.

The treatment modules 7.1-7.8 have identical base units. Each base unit has a lower module housing or machine housing 8 upon whose top is provided a rotor 9 that can be driven to rotate about a vertical machine axis. The periphery of the rotor 9 carries treatment stations 10 to which bottles 2 are transferred through a container inlet of the treatment module 7.1-7.8.

The treatment stations 10 treat bottles as the rotor 9 carries them along an angular range of its rotary motion. Bottles are then individually passed on to a treatment station 10 of a subsequent treatment module 7.2-7.8 or to the second conveyor 5.

A controller drives the rotors 9 of the treatment modules 7.1-7.8 that succeed one another in the transport direction A. It does so by driving them synchronously and with the same rotary or angular speed, but in opposite directions B, C, as shown in FIG. 1.

The treatment stations 10 of treatment modules 7.1-7.8 are matched to the respective treatment by corresponding units and/or functional elements provided on the base unit.

In the case of the embodiment depicted in FIG. 1, the treatment stations 10 of the first treatment module 7.1 are configured for a pretreatment of bottles 2.

The treatment stations 10 of the second through seventh treatment modules 7.2-7.7 act as print modules for the printing, preferably digital printing, of bottles 2 on their outer surfaces. Printing includes applying polychrome printed images to outer surfaces of the bottles 2, and preferably in different regions of that outer surface. Accordingly the treatment stations 10 of the second through seventh treatment modules 7.2-7.7 have inkjet printing heads.

The eighth treatment module 7.8 acts as a drying and sterilization module for the drying or curing of the printed images while concurrently sterilizing the bottles 2, at least on a region thereof on which such sterilizing is necessary because of the production of bottles 2, the source materials used for their production, and/or the handling of bottles 2 after their production.

In the illustrated embodiment, UV radiation both cures the print and sterilizes the bottles. The UV spectrum is optimized for curing the printing dye and for killing bacteria. A useful UV spectrum includes clearly pronounced peak at a wavelength of approximately 270 nanometers.

Figure 3:
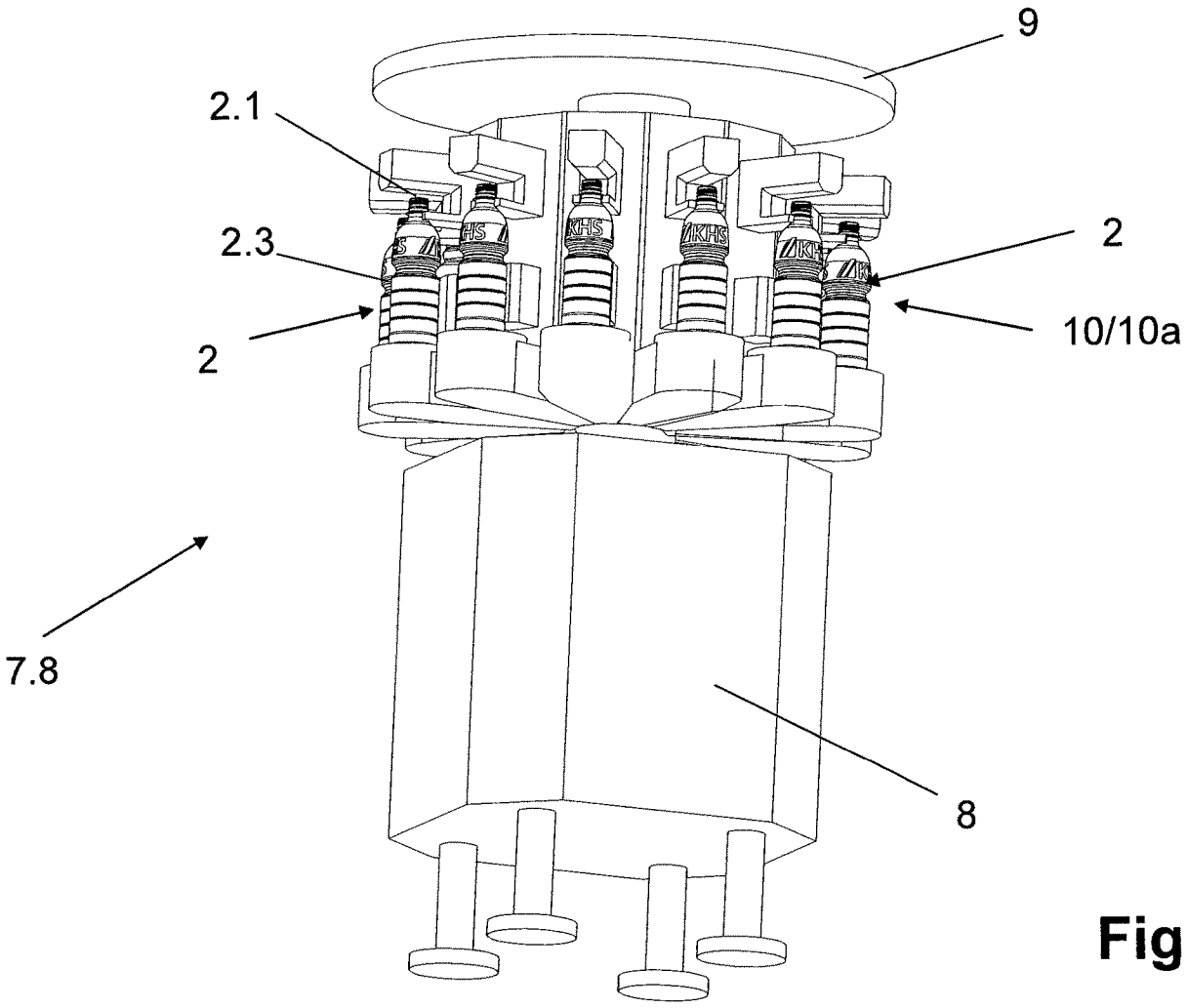
FIG. 3 shows a perspective depiction of one of the treatment modules of the installation of FIG. 1, in this case for example for the simultaneous curing of the print applied to the respective bottle and for sterilizing the bottles in the region of at least their bottle mouth.

FIG. 3 shows the eighth treatment module 7.8 in detail. Each treatment station 10, shown in close-up in FIG. 4, has a fork-like or gripper-like container carrier 11 that suspends a bottle 2 by its neck ring 2.2. Each treatment station 10 also has a first UV source 12 and a second UV source 13.

The first UV source 12 is located above the container carrier 11, and hence above opening 2.1 of the bottle 2 present at treatment station 10. The first UV source 12 has a UV lamp that is directed downwards onto the region of the bottle opening 2.1.

The second UV source 13 lies radially on the inside relative to a machine axis of the eighth treatment module 7.8. The second UV source 13 emits light onto surface of bottle 2. This second UV source 13 cures and dries the printing dye. There The bottle 2 rests on a turntable 14 that can be rotated bout a vertical axis thereof to rotate the bottle 2.

The container carrier 11, the first and second UV sources 12, 13 and the turntable 14 are provided on a housing 15 on which the container carrier 11 and the first UV source 12 can be moved vertically up and down along a vertical direction D. The housing 15 accommodates components needed to operate and/or cool the UV lamps of the first and second UV sources 12, 13. The container carrier 11, the first and second UV sources 12, 13, the turntable 14, and the housing 15 collectively define an assembly unit 16 that is provided on the rotor 9. The assembly unit 16 forms one of the treatment stations 10 of the eighth treatment module 7.8.

To promote smooth acceptance and delivery of a bottle 2 at the transfer region between the seventh and eighth treatment modules 7.7, 7.8 and at the transfer region between the eighth treatment module 7.8 and the second conveyor 5, the container carrier 11 and the first UV source 12 are each raised and, during the treatment, lowered such that the bottle 2 stands upright on the turntable 14 with its base. The turntable 14 then rotates the bottle about the vertical turntable axis. This rotation permits the second UV source 13 to treat the entire periphery of the bottle 2. During this procedure, the container carrier 11 steadies the upright bottle 2 so that it does not fall over.

In the preceding embodiment, the container carrier 11 and the first UV source 12 move up and down. However, it is also possible to instead move the turntable 14 vertically up and down to facilitate, in the manner mentioned above, smooth transfer and delivery of bottles 2 to and from respective treatment stations 10 on the one hand and on the other the rotation of bottles 2 about their vertical bottle axis during the treatment.

In some embodiments, the treatment stations 10 only UV-sterilize bottles 2 the region of their bottle mouth opening 2.1. As a result, either the bottles 2 should be substantially sterile after they have been manufactured or the bottles 2 should be formed from sterile preforms. In either case, further handling on the transport path to a treatment section 1 or within a treatment section 1 should contaminate bottles 2 only in the region of their bottle mouth 2.1.

Figure 5:
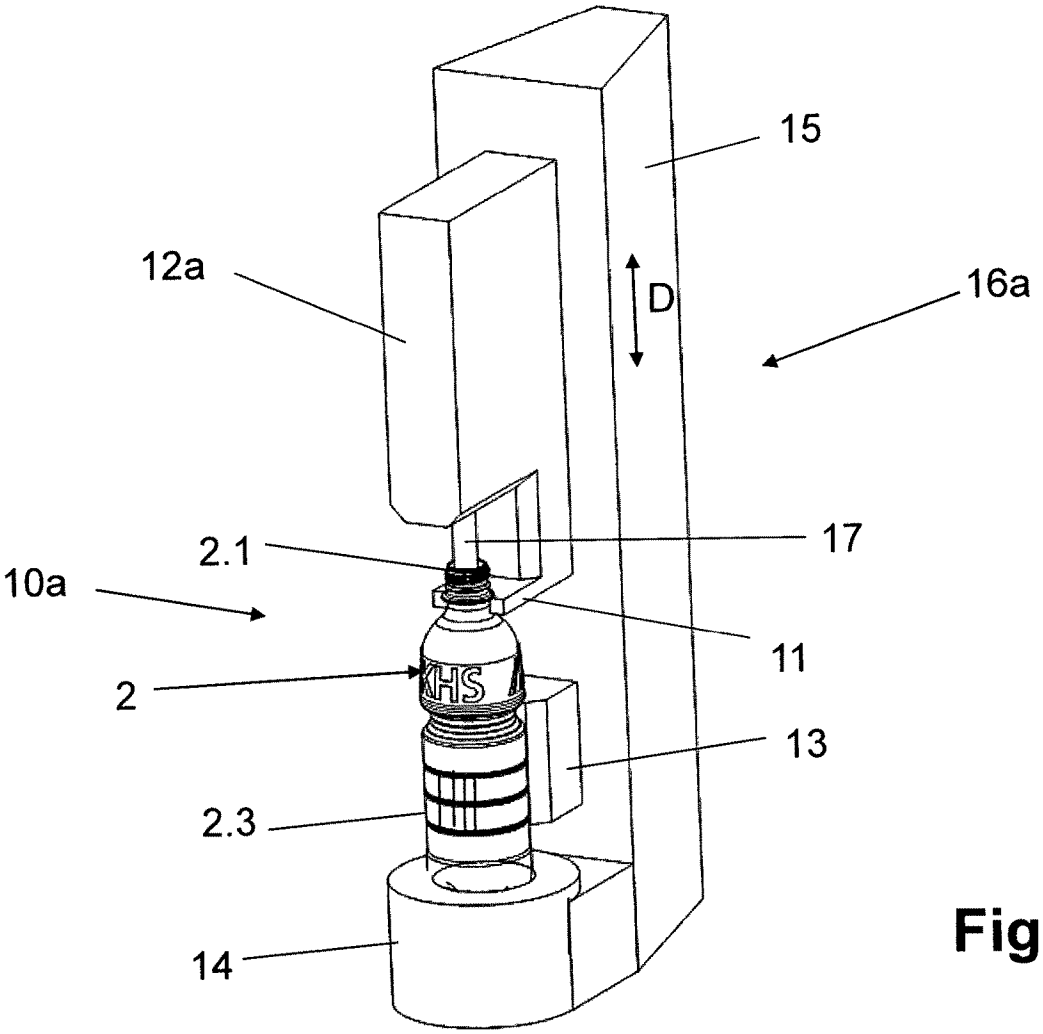
FIG. 5 shows a depiction similar to FIG. 4 but in another embodiment of the treatment module.

In an alternative embodiment shown in FIG. 5, a treatment station 10*a* has a first UV source 12*a* above a container carrier 11 that is configured to emit UV radiation for sterilizing at least of the entire inner surface of a bottle 2. In this embodiment, during treatment, a UV lamp or light guide 17 extends through bottle opening 2.1 and into the interior of bottle 2. As was the case with the first embodiment, this embodiment also sterilizes bottles 2 and cures or dries a printed image 2.3 within the same treatment station 10*a* of the eighth treatment module 7.8, and preferably simultaneously.

The treatment station 10*a* is particularly useful because, even transparent bottles 2 absorbs so much UV radiation that UV radiation cannot pass through the wall of the bottle and adequately sterilize the interior in any commercially viable way. In particular, the UV power and the time required to achieve adequate sterilization by a source outside the bottle 2 would be prohibitive.

In some embodiments, the treatment module 10*a* is configured to sterilize both a bottle's inner surface its outer surface, particularly in the region of bottle opening 2.1 through the use of UV radiation.

In some embodiments, lowering the container carrier 11 or raising the turntable 14 uncouples the 2 the bottle from the container carrier 11, thereby allowing it to be rotated about its bottle axis during the treatment. However, it is possible to uncouple the bottle in other ways. For example, the container carrier 11 can be configured to release a bottle 2 during treatment to permit the bottle to be rotated about its bottle axis. In other embodiments, the container carrier 11 is configured to actually bring about bottle's rotation during treatment.

The first treatment module 7.1 is configured for a pretreatment of a bottle 2 so that the printing dye adheres better to the bottle's surface. This pretreatment is effected by irradiating surfaces that are to be subsequently printed with UV radiation.

The improvement in the adhesion of the printing dye arises in part because UV radiation, and in particular, UV radiation having a wavelength of less than 240 nm, splits oxygen molecules close to the treated surfaces. This forms ozone that, together with the oxygen, absorbs UV quanta that have wavelengths below 240 nm. This process forms many radicals, such as COO*, *OH, CO*, and COOH*. It also forms radicals on the plastic chains of the material from which the bottles 2 are made. This bring about localized changes to the symmetry of the molecular structure. An effect of these localized changes is that of increasing the surface energy and improving the adhesion strength and wettability of the surfaces that are to be printed with printing dye. This pretreatment of bottles 2 with the UV radiation is preferably accompanied by a sterilization or disinfection of the outer surface of bottles 2.

To achieve this pretreatment, the first treatment module 7.1 has treatment stations 10, 10*a* similar to those of the eighth treatment module 7.8 but with the omission of the first UV sources 12, 12*a*.

Other treatment methods and appropriately configured treatment stations for improving the adhesion strength and wettability of the printed surfaces of bottles 2 are also possible for the first treatment module 7.1. In some embodiments, the first treatment module 7.1 has treatment stations 10 that carry out surface silicatizing of the bottles' surfaces by pyrolysis, for example flame pyrolysis. This generates a thin but very dense and firmly adhering silica layer with high surface energy. This silica layer provides high adhesion strength for a printing dye on the outer surface of respective bottle 2. In some embodiments, such a treatment station carries out flame treatment of bottles 2 using a suitable gas, for example propane and/or butane in the presence of an organic silicon compound, such as silane.

Some embodiments of the first and eighth treatment stations 7.1, 7.8 achieve especially beneficial results by irradiating the bottles 2 with UV radiation in a low-oxygen, sterile inert gas atmosphere. Suitable inert gases include nitrogen, carbon dioxide, and any of the noble gases. This advantage arises because atmospheric oxygen inhibits the cross linking reaction and/or curing of common polymer printing dyes. The use of a low-oxygen inert gas atmosphere thus improves curing or drying times and the hard-drying of the printing dye.

Another advantage of irradiating with a low-oxygen atmosphere is that when there is very little oxygen, there will also be very little ozone. This is of particular importance because the optimal wavelengths for UV sterilization are significantly below 240 nanometers. These wavelengths have a propensity for forming ozone.

An oxygen-lean atmosphere thus makes it possible to use very short-wave UV radiation for a rapid and high quality UV sterilization. In particular, it becomes possible to use UV radiation having wavelengths between 170 and 280 nanometers, and in particular, those having wavelengths in a preferred range of between 170 and 220 nanometers. It would not be practical to use such short wavelengths in the presence of significant oxygen because UV radiation in the 170-200 nm range can only effectively propagate through an oxygen-rich atmosphere for 1 to 10 millimeters at best. In the case of UV radiation having a wavelength of 200 nm, the oxygen's partial pressure in the shielding gas atmosphere or inert gas atmosphere should be at most 0.5%, and preferably only 0.1% of total pressure.

When a low-oxygen shielding gas or sterile gas atmosphere is used during UV sterilization and UV curing, the treatment stations 10 and 10*a* are disposed in an enclosure filled with the shielding or inert gas at a positive pressure sufficient to ensure that, at the inlet and outlet of the enclosure, inert gas flows out of the housing and into the surrounding area. This prevents ingress of oxygen into the enclosure.

Some embodiments expose the surface and/or interior of the bottles 2 to a cooled process gas or inert gas during UV sterilization and UV curing. Among other things, such exposure reduces the thermal burden on bottles 2 during UV sterilization and UV curing and reduces emission of infrared radiation from bottles 2.

Some embodiments introduce a cool process gas into the bottle 2. This process gas is cooler than the bottle 2. In this case, the process gas in the bottle 2 begins with a higher density. As it heats up in the bottle, it expands. In so doing, some of it begins to flow out of bottle 2. This prevents ingress of oxygen into the bottle 2.

In the preceding embodiments, UV sterilization and/or curing occurs in an eighth treatment module 7.8 of a treatment section 1 that precedes a filling machine. However, it is also possible to incorporate UV sterilization and/or UV curing in a treatment station of a filling machine. In such embodiments, it is possible to sterilize filling material introduced into a bottle 2 in at least one treatment station. This can be carried out, for example, when bottling mineral waters or table waters.

In the preceding embodiments, pretreatment, printing, and UV sterilization and UV curing are described has taking place in separate processing modules 7.1-7.8. However, it is possible for a single processing module to perform more than one of these tasks.

In other embodiments, particularly in the case of polychrome printing, it is possible to pre-dry a first printing dye before applying a second printing dye and to do so in one or more additional work steps.

In the embodiments described thus far, bottles 2 conveyed through the treatment section 1 stand upright, i.e. with their bottle opening 2.1 pointing up and their bottle axis vertically oriented. Thus, UV treatment in the eighth treatment module 7.8 also takes place in this position. However, embodiments also include those in which the bottles 2 are in a different attitude. These include embodiments in which the bottle is upside-down, so that the bottle opening 2.1 faces downward.

Figure 6:
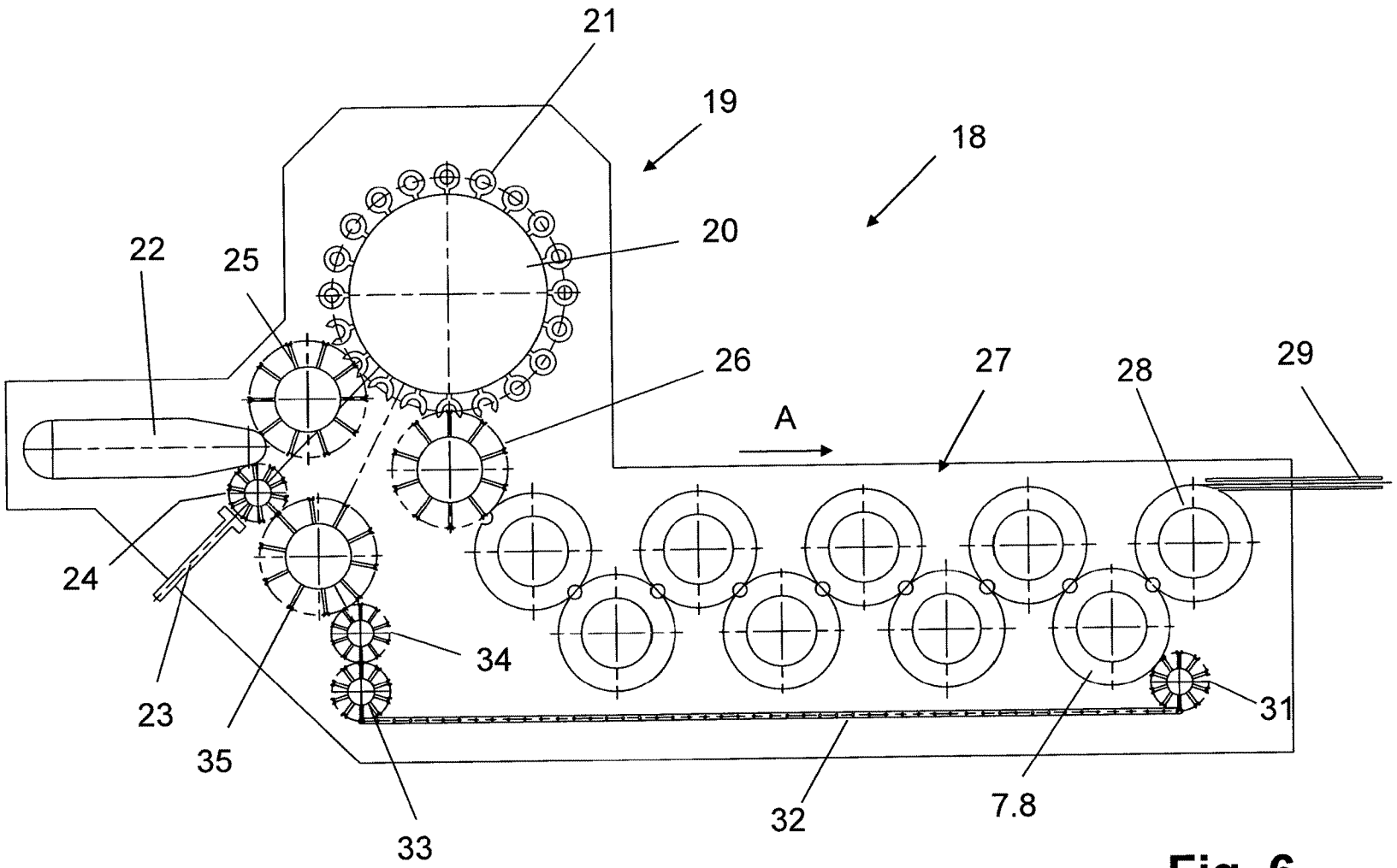
FIG. 6 shows a simplified depiction in plan view of an installation for producing the containers in the form of plastic bottles, for example in the form of PET bottles by stretch or blow molding, and also for the subsequent treating of the produced containers.

FIG. 6 shows an installation 18 for blow-molding bottles 2 and for the subsequently printing a printed image on the bottles and using UV radiation to sterilize the bottles and cure the printed image. The installation 18 comprises among other things a rotary blow-molding machine 19 having a plurality of blow molds 21. The blow-molding machine 19 includes a rotor 20 that can be driven to rotate about a vertical machine axis. The blow molds 21 are disposed on the side or top of the rotor 20.

During normal operation, the heated preforms are fed to the blow molds 21 over a transport section that includes a preheating section 22. The transport section includes a third conveyor 23 and first and second transport star wheels 24, 25.

A third transport star wheel 26 transfers bottles 2 produced by the blow-molding machine 19 to a treatment section 27. In some embodiments, the treatment section 27 is the same as treatment section 1. The bottles 2 traverse the treatment section 27 to undergo treatment steps already described. After leaving the eighth treatment section 7.8, the bottles 2 are fed via a fourth star wheel 28 and a fourth conveyor 29 to a filling machine.

The transport of bottles 2 from the blow-molding machine 19 to the treatment section 27, through the treatment section or through the various treatment modules or workstations of this treatment section as well as the transport on the fourth star wheel 28 takes place with the bottle upside-down.

A basic difference between the treatment section 27 shown in FIG. 6 and the treatment section 1 shown in FIG. 1 is that in the treatment section 1 shown in FIG. 1, each container carrier 11 is a permanent part of the treatment stations 10, 10*a* of an individual treatment module 7.1-7.8.

Figure 8:
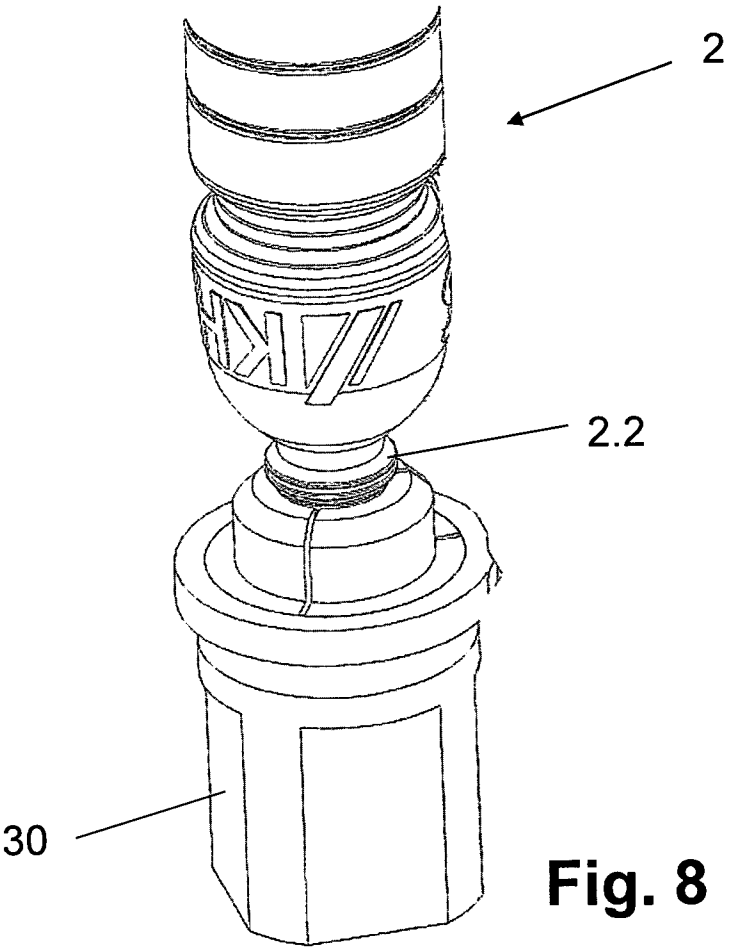
FIGS. 7 and 8 show a centering and holding element for use with the device of FIG. 6 with a preform and/or a partially depicted bottle.
Figure 7:
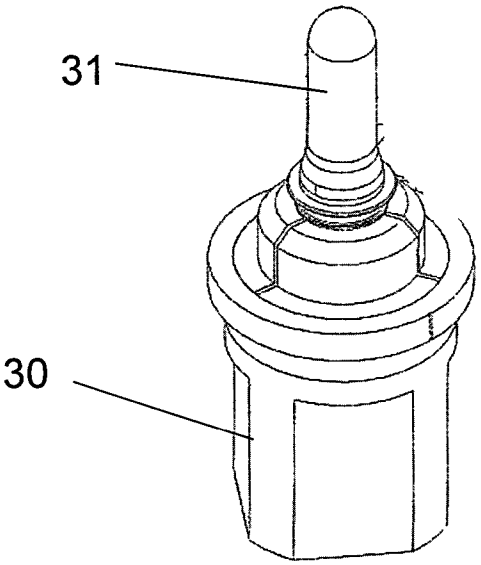

In contrast, in the installation 18 shown in FIG. 6, the same gripper or centering and holding element 30, best seen in FIGS. 7 and 8, is used throughout the process.

In particular, FIG. 7 shows a preform 31 after having been transferred from the third conveyor 23 onto a centering and holding element. FIG. 8 shows the preform after having been transformed into a bottle 2 by blow-molding. As is apparent, the bottle 2 is already held centered. The centering and holding element 30 carries the bottles 2 all the way down the treatment section 27 to the eighth treatment module 7.8, where UV sterilizing of the bottle 2 takes place.

It is only after the bottle 2 has passed through the eighth treatment module 7.8 to the fourth star wheel 28 that bottle 2 is released from centering and holding element 30. Having been sterilized in the eighth treatment module 7.8, the centering and holding element 30 is then returned to the blow-molding machine 19 or to the first star wheel 24 by traversing a return path 32, 33, 34, 35, 36 to pick up a further preform 31.

An advantage of the embodiment shown in FIG. 6 is therefore that the same centering and holding element 30, which has already been sterilized and disinfected, holds the preform 31 and the resulting bottle 2.

Each centering and holding element 30 is configured so as to enable the bottle 2 to swivel or rotated during its treatment, and in particular, during UV sterilizing or UV curing. To achieve this, each centering and holding element 30 either has its own actuator drive or a coupling to enable it to be swiveled or rotated by a drive of a particular treatment station 7.1-7.8.

In some embodiments, the centering and holding elements 30 are configured to hold a bottle 2 in the region of its bottle mouth 2.1, for example by clamping and/or with clamping jaws.

The invention has been described hereinbefore by reference to embodiments. It goes without saying that numerous variations as well as modifications are possible without departing from the inventive concept underlying the invention.

The invention claimed is:

1. A method comprising treating a container that has had an image digitally printed on an outer surface thereof, said image comprising a colorant, said colorant comprising at least one of printing dye and printing ink, wherein treating comprises simultaneously processing said colorant and decontaminating a region of said container using the same radiation, said radiation being non-thermal energy radiation, wherein processing comprises at least one of drying and curing, wherein decontaminating comprises at least one of sterilizing and disinfecting, and wherein said region comprises said container's inner surface.

2. The method of claim 1, wherein using the same radiation comprises using electron radiation.

3. The method of claim 1, further comprising causing a common treatment module to receive said container from a last printing module of a plurality of printing modules in a treatment section, each of said printing modules being separate and distinct from said treatment module and from each other, said treatment module and said printing modules comprising identical base units, each of which has a housing upon whose top is a rotor that can be driven to rotate about a vertical machine axis, wherein said rotor of said treatment module comprises a periphery that carries treatment stations to which bottles are transferred through a container inlet of said treatment module, wherein said container moves through said treatment section in a meandering path that comprises multiple curved paths, each of which corresponds to one of said modules.

4. The method of claim 1, further comprising pre-curing said colorant before said processing and said decontaminating.

5. The method of claim 1, further comprising pre-drying said colorant before said processing and said decontaminating.

6. The method of claim 1, further comprising pretreating said outer surface of said container using said radiation.

7. The method of claim 1, further comprising forming a silica layer on said outer surface.

8. The method of claim 1, further comprising receiving said container at a treatment module that is one of plural modules along a transport section through which said container moves along a meandering transport path, said plural modules comprising plural printing modules, wherein said modules are separate and distinct from each other, wherein each of said modules comprises a rotor.

9. The method of claim 1, further comprising at least one of charging and purging said container with a shielding gas while concurrently processing said colorant and decontaminating said region of said container, said shielding gas being at a temperature below that of said container.

10. The method of claim 1, wherein concurrently processing said colorant and decontaminating said region of said container using the same radiation is carried out in an atmosphere having an oxygen partial-pressure of between 0.5% and 0.1% of total pressure.

11. The method of claim 1, further comprising, causing a centering-and-holding element to carry a vertically-oriented container, causing said centering-and-holding element, with said vertically-oriented container, to move along a plurality of meandering transport paths from one module to a subsequent module of a treatment section, thereby bringing said container into and out of treatment modules that follow one another along a transport direction, and swiveling said container about a container axis thereof while processing and decontaminating, wherein said centering-and-holding element remains with said container while said container is outside any module.

12. The method of claim 1, further comprising, prior to said container having been formed from a preform, using said radiation to sterilize a centering-and-holding element and causing said centering-and-holding element to return to a module to pick up said preform, to hold said preform in a vertical orientation, and to bring said preform toward another module at which said concurrent decontaminating and processing take place.

13. The method of claim 1, further comprising holding said container with a centering-and-holding element during said processing and decontaminating, causing said centering-and-holding element to release said container, after said centering-and-holding element has released said container, uncoupling said centering-and-holding element from a transport system, and returning said centering-and-holding element, as an independent unit, to an entrance of a treatment section through which containers move along a meandering transport path into and out of plural treatment modules.

14. The method of claim 1, wherein said radiation is microwave radiation.

15. The method of claim 1, wherein said decontaminating comprises causing said radiation to propagate through free space outside said container in a direction towards said region, wherein said radiation originates at a source that is outside said container.

16. The method of claim 1, wherein said decontaminating comprises causing radiation to propagate through free space from a source of said radiation towards said region, wherein said source lies directly above an opening of said container.

17. The method of claim 1, further comprising splitting oxygen molecules above said outer surface prior to printing on said outer surface.

18. The method of claim 1, further comprising, causing a centering-and-holding element to carry a vertically-oriented container, causing said centering-and-holding element, with said vertically-oriented container, to moves along a plurality of meandering transport paths from one module to a subsequent module of a treatment section, thereby bringing said container into and out of treatment modules that follow one another along a transport direction, and causing said container to experience vertical relative motion while processing and decontaminating.

19. The method of claim 1, wherein said container stands on a turntable that rotates said container about a vertical axis thereof.

20. The method of claim 1, further comprising selecting said radiation to have a wavelength that is absorbed by oxygen gas.

21. The method of claim 1, further comprising selecting said radiation to have a wavelength that is sufficiently small to split oxygen molecules.

22. The method of claim 1, further comprising suppressing diffusion of oxygen into said container.

23. An apparatus comprising a treatment or transport section for a container, said treatment or transport section comprising a printing module for digitally printing on an outer surface of said container using a colorant and a treatment module for simultaneously processing said colorant and decontaminating an inner surface of said container using the same radiation, wherein said colorant comprises at least one of printing dye and printing ink, wherein processing said colorant comprises at least one of drying said colorant and curing said colorant, and wherein decontaminating said container comprises at least one of disinfecting and sterilizing said container.

24. The apparatus of claim 23, further comprising a pre-treatment module for pre-processing said colorant, wherein said pre-treatment module is separate and distinct from said printing module and said treatment module, wherein pre-processing comprises at least one of pre-drying said colorant, pre-curing said colorant, and pre-treating said container on a region of said outer surface.

25. The apparatus of claim 23, further comprising a pre-treatment module upstream of said treatment module, said pre-treatment module being configured to cause a silica layer to adhere to said outer surface.

26. The apparatus of claim 23, wherein said radiation comprises ultraviolet radiation.

27. The apparatus of claim 26, wherein said ultraviolet radiation has a wavelength between 170 nanometers and 280 nanometers.

28. The apparatus of claim 23, wherein there exist first and second UV sources, wherein said first UV source is directed downward onto a region of an opening of said container and said second UV source is directed towards a side of said container.

29. The apparatus of claim 23, wherein said treatment module is maintained at positive pressure during operation thereof and wherein gas from inside said treatment module flows out of said treatment module.

30. An apparatus for treating a container, said apparatus comprising means for transporting and treating said container, said means for transporting and treating comprising means for digitally printing on an outer surface of said container using a colorant and means for simultaneously decontaminating an interior surface of said container and processing said colorant with non-thermal radiation.

* * * * *